US011247495B2

(12) United States Patent
Gotschewski et al.

(10) Patent No.: US 11,247,495 B2
(45) Date of Patent: Feb. 15, 2022

(54) PRINT HEAD MECHANISM

(71) Applicant: ZEBRA TECHNOLOGIES CORPORATION, Lincolnshire, IL (US)

(72) Inventors: Robert P. Gotschewski, Schaumburg, IL (US); Daniel V. Carroll, Port Barrington, IL (US); Dwight D. Dipert, Barrington, IL (US); Thomas P. Zwier, Lake Zurich, IL (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 16/863,722

(22) Filed: Apr. 30, 2020

(65) Prior Publication Data

US 2021/0339547 A1 Nov. 4, 2021

(51) Int. Cl.
*B41J 23/00* (2006.01)
*B41J 25/00* (2006.01)

(52) U.S. Cl.
CPC ..... *B41J 25/001* (2013.01)

(58) Field of Classification Search
None
See application file for complete search history.

(56) References Cited

U.S. PATENT DOCUMENTS

| | | | | |
|---|---|---|---|---|
| 5,409,271 | A * | 4/1995 | Hoffmann | E05B 63/0004 292/62 |
| 8,985,730 | B2 | 3/2015 | Gotschewski | |
| 9,302,509 | B2 | 4/2016 | Anderson et al. | |
| 10,486,448 | B2 | 11/2019 | Gotschewski et al. | |
| 2005/0253893 | A1* | 11/2005 | Griesemer | B41J 29/13 347/37 |
| 2017/0225496 | A1* | 8/2017 | Gotschewski | B41J 2/335 |

* cited by examiner

*Primary Examiner* — Erica S Lin
*Assistant Examiner* — Tracey M McMillion

(57) ABSTRACT

A print head assembly for a media processing device comprises: a print head including an interface and a latch receiver on an upper surface of the print head; and a print head carrier including: (i) a base plate having an opening to receive the latch receiver therethrough when the print head is positioned at a lower surface of the base plate; (ii) an adapter to engage with the interface of the print head; and (iii) a latch bar on an upper surface of the base plate, the latch bar slideable between a first position to engage with the latch receiver and lock the print head to the base plate, and a second position to disengage from the latch receiver and release the print head from the base plate.

17 Claims, 9 Drawing Sheets

PRINT HEAD MECHANISM

BACKGROUND

A print head of a media processing device, such as a thermal label printer, may be removed from the device for maintenance or replacement due to wear, or for replacement with another print head having different operational characteristics such as resolution. Removing and replacing a print head, however, may be complicated by limited space within the device. In addition, configuring a media processing device with different operational characteristics, such as print head resolution, may result in misalignment of the print head within the device.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
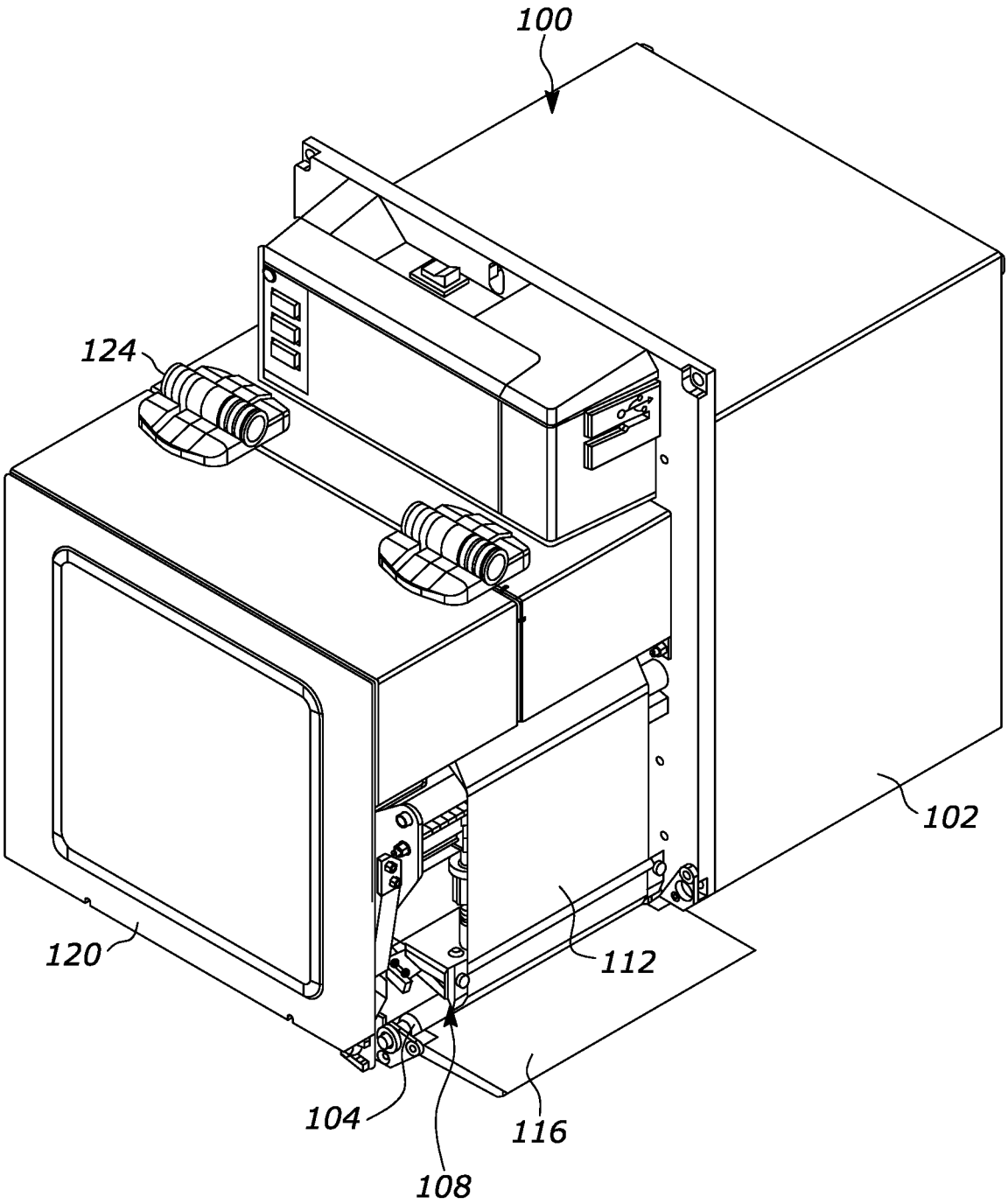
FIG. 1 is an isometric view of a media processing device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Media processing devices, such as thermal printers, apply indicia to media such as labels, paper and the like at a nip formed between a print head and a platen roller. The print head includes a set of individually controllable dots (e.g. arranged in a line across the path travelled by the media). As the media traverses the nip, the print head is controlled to heat certain dots to cause the transfer of pigment from a ribbon to the media, or to cause pigmentation of thermally sensitive compounds in the media itself.

The print head may be periodically removed from the media processing device for maintenance or replacement due to wear or other malfunction. Removing a print head from a media processing device may require accessing the interior of the media processing device by an operator, and manipulation of fasteners such as screws or bolts, as well as disconnection (and later reconnection) of cables or the like. Space within the media processing device may be limited and render the manipulation of such components difficult. Such difficulties may complicate the removal and insertion of print heads, and increase the likelihood of improper removal or installation, leading to damage, printing malfunction, and the like.

Print heads may also be exchanged in a media processing device to configure the media processing device with different operational characteristics. For example, a media processing device deployed for a given task or set of tasks may be equipped with a first print head having a resolution of six hundred dots per inch (DPI). Such a print head may also be controlled to provide an effective resolution of three hundred DPI (by controlling the dots of the print head in pairs). To configure the media processing device with a print resolution of, for example, two hundred rather than three hundred or six hundred DPI, a different print head may be installed in the media processing device.

The dimensions of the above-mentioned line of dots (also referred to as a print line) may vary between print heads with differing resolutions. The media processing device, however, may define a fixed first-dot position to which one end of the print line is required to be aligned. The variable dimensions of the print lines of different print heads may therefore require that multiple versions of each print head resolution be manufactured for compatibility with different printers.

Examples disclosed herein are directed to a print head assembly for a media processing device comprises: a print head including an interface and a latch receiver on an upper surface of the print head; and a print head carrier including: (i) a base plate having an opening to receive the latch receiver therethrough when the print head is positioned at a lower surface of the base plate; (ii) an adapter to engage with the interface of the print head; and (iii) a latch bar on an upper surface of the base plate, the latch bar slideable between a first position to engage with the latch receiver and lock the print head to the base plate, and a second position to disengage from the latch receiver and release the print head from the base plate.

FIG. 1 depicts a media processing device 100, such as a thermal transfer printer. The device 100, as illustrated in FIG. 1, may also be referred to as a print engine, in that the device 100 is configured to allow integration of the device with other equipment such as industrial machinery. For example, the device 100 can include a housing 102 that is configured for placement on or in such other machinery, and leaves certain components, such as those described below, at least partially exposed to the exterior of the device 100.

The device 100 accepts media, e.g. labels, paper or the like, from a media supply external to the device 100. The media travels along a media path through the device 100 to a nip formed by a platen roller 104 and a print head of a print head assembly 108. As the media traverses the nip, indicia are applied to the media by the print head, e.g. by thermal transfer of ink from a ribbon 112 to the media. After the media traverses the nip, the media exits the device 100 at an outlet, e.g. including dispensing bar 116.

The print head assembly 108 may be accessed by an operator, e.g. for replacing the print head and, dependent on the type of print head installed therein, adjusting a position of the print head assembly 108. Access may be provided, for example, by a door 120 supported by the housing 102 and movable on hinges 124 between a closed position shown in FIG. 1, and an open position in which the interior of the device 100 is accessible.

Figure 2:
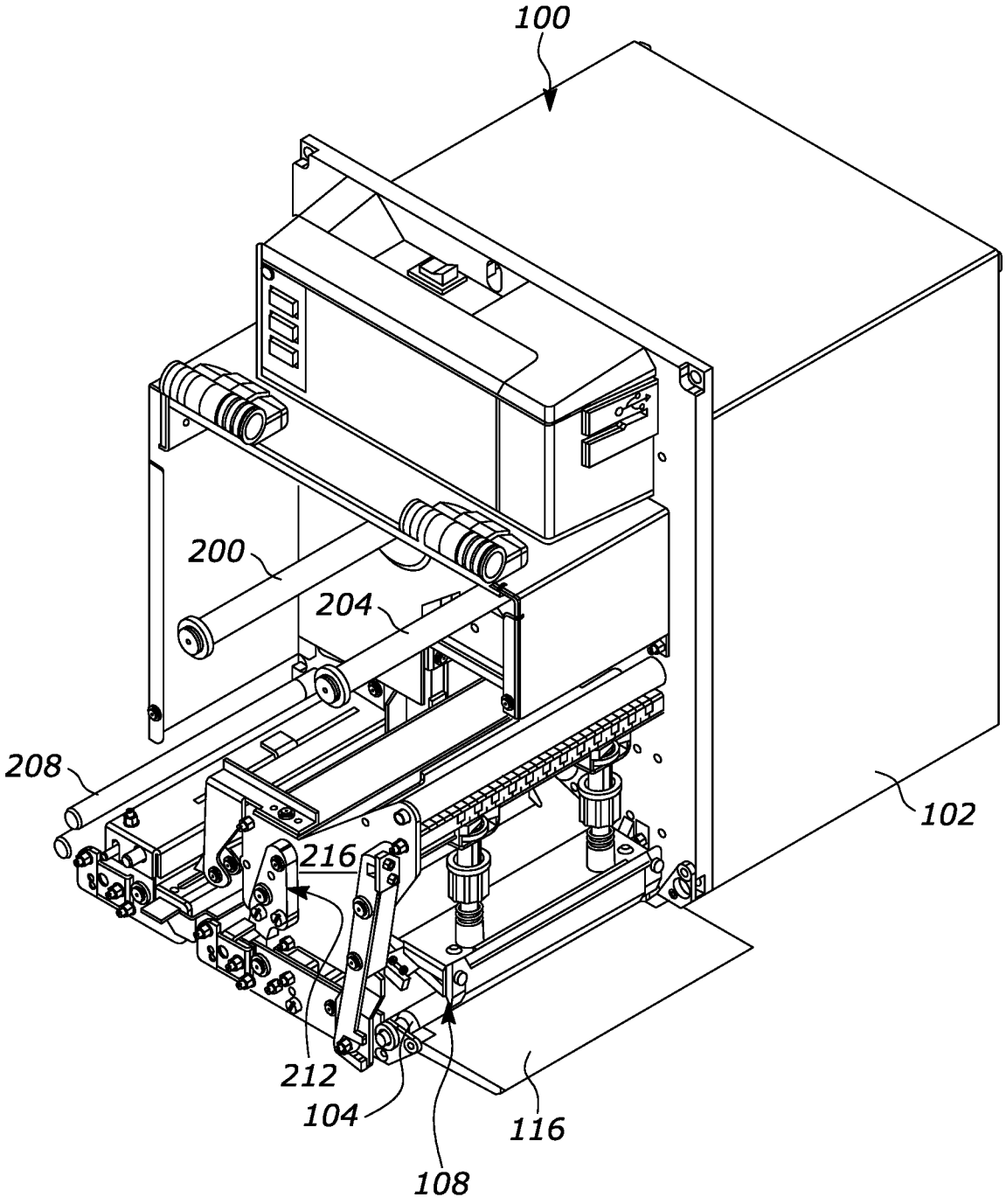
FIG. 2 is an isometric view of the media processing device of FIG. 1 with a portion of a housing thereof removed.

FIG. 2 illustrates the device 100 with the door 120 and the ribbon 112 omitted to reveal certain internal components of the device 100. The interior of the housing 102 contains, among other components, a supply shaft 200 to support a supply roll of the ribbon 112, and a take-up shaft 204 to support a ribbon take-up roll. The device 100 also includes at least one guide shaft 208 defining a media inlet of the device 100. Media is received by the device 100 at the inlet defined by the guide shaft(s) 208, and travels through the device 100 to the nip formed by the platen roller 104 and the print head assembly 108.

The print head assembly 108 is movably supported on a shaft, to be discussed below in greater detail, that enables the print head assembly 108 to be transitioned between an operational position and a maintenance position. The operational position is as shown in FIG. 2. In the maintenance position, the print head assembly 108 is rotated upwards and away from the platen roller (e.g. towards the take-up shaft 204). The position of the above-mentioned shaft, and by extension the print head assembly 108, can be adjusted to configure the device 100 to accept print heads with different print line dimensions, while placing the first dot of such print heads at a consistent position. Adjustment of the position of the above-mentioned shaft can be enabled by an adjustment block 212 affixed to the housing 102, either directly or via a support such as a plate 216.

Figure 3:
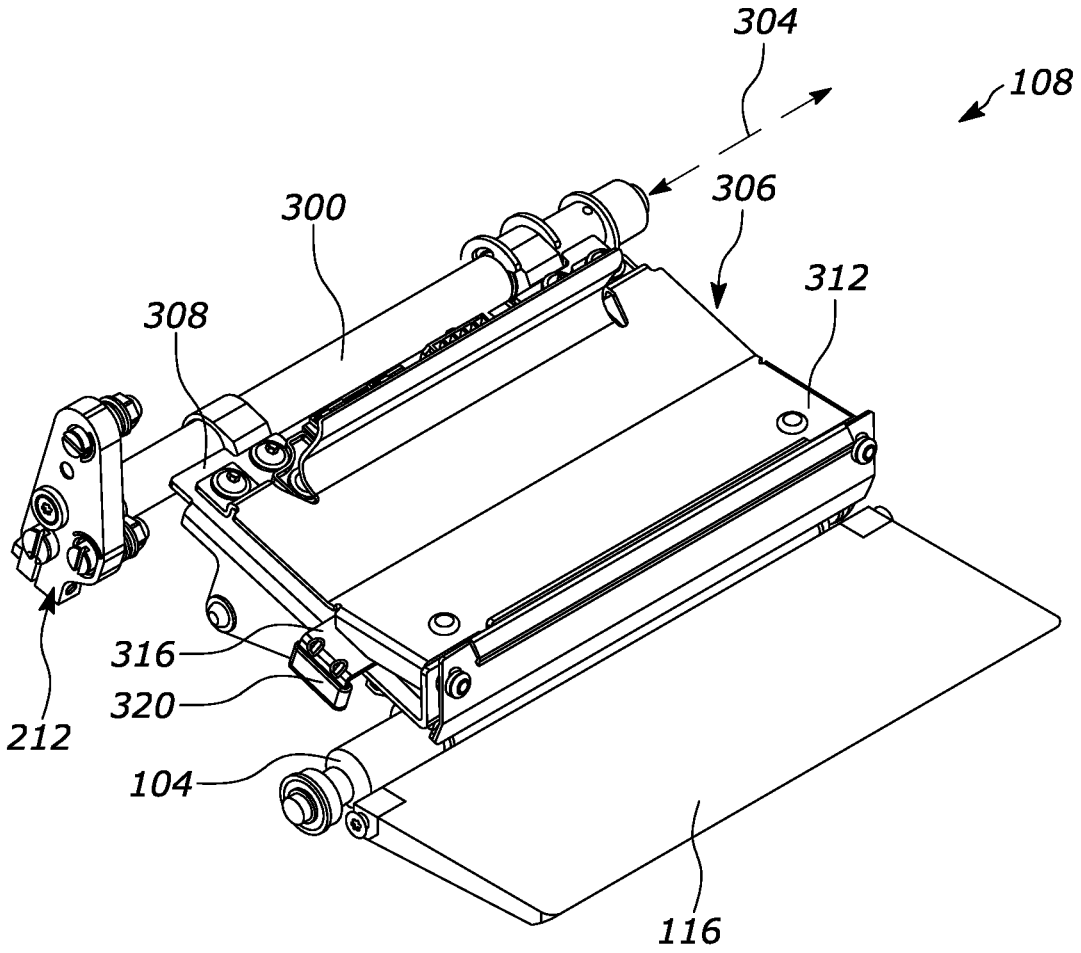
FIG. 3 is an isometric view of a print head assembly of the device of FIG. 1.

Turning to FIG. 3, the platen roller 104, print head assembly 108, and dispensing bar-116 are shown isolated from the remainder of the device 100. Also shown in FIG. 3, are the adjustment block 212 and a shaft 300 to which the print head assembly 108 is affixed. The shaft 300, as noted above, enables the print head assembly 108 to rotate from the operational position illustrated to a maintenance position in which the print head assembly 108 is lifted away from the platen roller 104. The positional adjustment of the shaft 300 mentioned above adjusts the axial position of the shaft 300, i.e. along a longitudinal axis 304 of the shaft 300. As will be apparent from FIG. 3, adjustment of the axial position of the shaft 300 also adjusts the position of the print head assembly 108 relative to the platen roller 104.

The print head assembly 108 includes a carrier 306 and a print head, which is not visible in FIG. 3. The print head is concealed from view in FIG. 3 by a base plate 308 of the carrier 306, and by a cover 312 of the carrier 306 supported on the base plate 308. The carrier 306, as will be described below, removably carries the print head, and is affixed to the shaft 300 via the base plate 308.

The print head is removably attached below the base plate 308 by way of a latching mechanism. The latching mechanism includes a latch bar 316, a portion of which (visible in FIG. 3) extends beyond a side of the base plate 308 for operator access. The exposed portion of the latch bar 316 includes, in the present example, a handle portion 320, e.g. disposed at an angle relative to the remainder of the latch bar 316, to assist an operator in activating the latching mechanism.

Figure 4A:
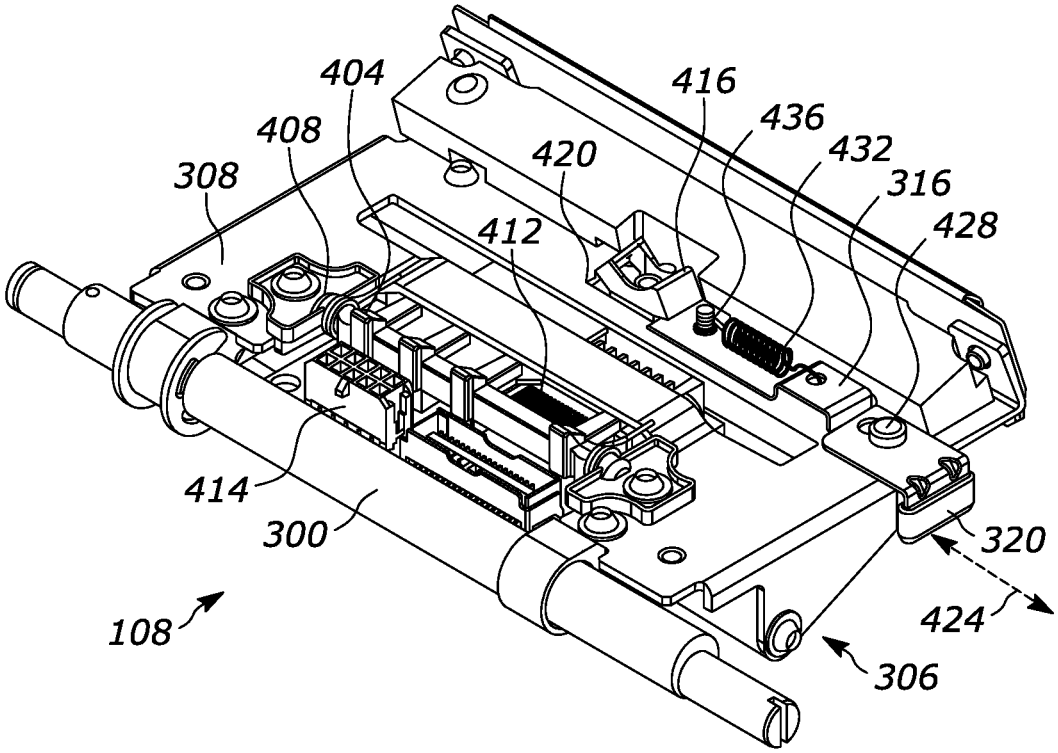
FIG. 4A is an isometric view of the print head assembly of FIG. 3 with a print head thereof in an operational position.
Figure 4B:
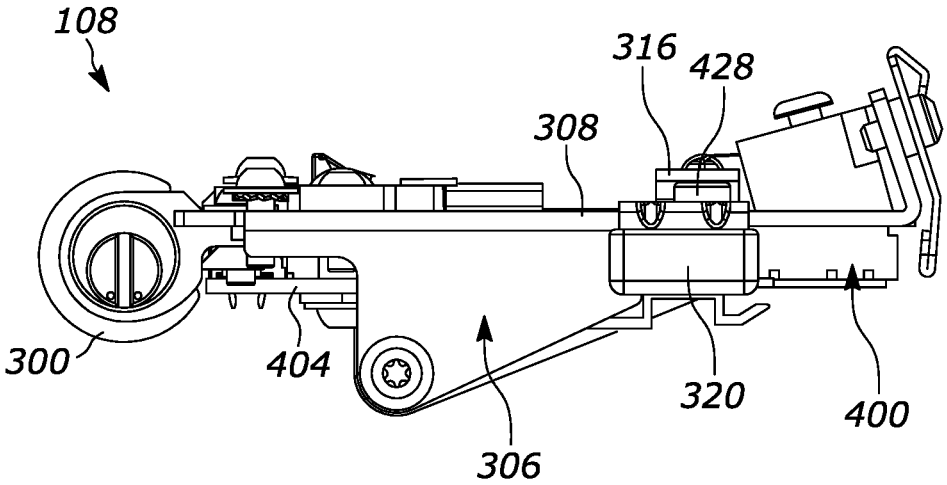
FIG. 4B is a side view of the print head assembly illustrated in FIG. 4A.

Turning to FIGS. 4A and 4B, the latching mechanism mentioned above will be described in greater detail. FIG. 4A is an isometric view of the shaft 300 and the carrier 306, with the cover 312 omitted, while FIG. 4B is a side view of the above. FIGS. 4A and 4B illustrate the print head assembly 108 in an operational configuration, in which the print head 400 (visible in FIG. 4B) is secured to an underside of the base plate 308 by the above-mentioned latching mechanism.

The carrier 306 includes an adapter 404 rotatably mounted to the base plate 308 via a shaft 408. The adapter includes an electrical interface, such as a port 412, for engaging with a corresponding electrical interface (e.g. a connector) of the print head 400. The adapter 404 also includes a printer interface 414, such as one or more ports, plugs or the like to receive data and power from other components of the device 100. The adapter is configured to rotate about an axis defined by the shaft 408 between the operational position shown in FIGS. 4A and 4B, and a maintenance position discussed later herein in connection with FIGS. 5A and 5B.

The latching mechanism for securing the print head 400 to the carrier 306 includes the above-mentioned latch bar 316, and a latch receiver 416 of the print head. In particular, the latch receiver 416 is affixed to an upper surface of the print head 400. The base plate 308 includes an opening 420 that is sized to receive the latch receiver therethrough when the print head 400 is placed against the lower surface of the base plate 308. The latch receiver 416 includes a ledge, shown in greater detail in subsequent drawings, that receives an end of the latch bar 316 thereunder, such that the latch bar 316 prevents the latch receiver 416 from being withdrawn from the opening 420. In other words, when the latch bar 316 engages with the latch receiver 416, the latch bar 316 and the latch receiver 416 cooperate to lock the print head 400 against the lower surface of the base plate 308.

Figure 5A:
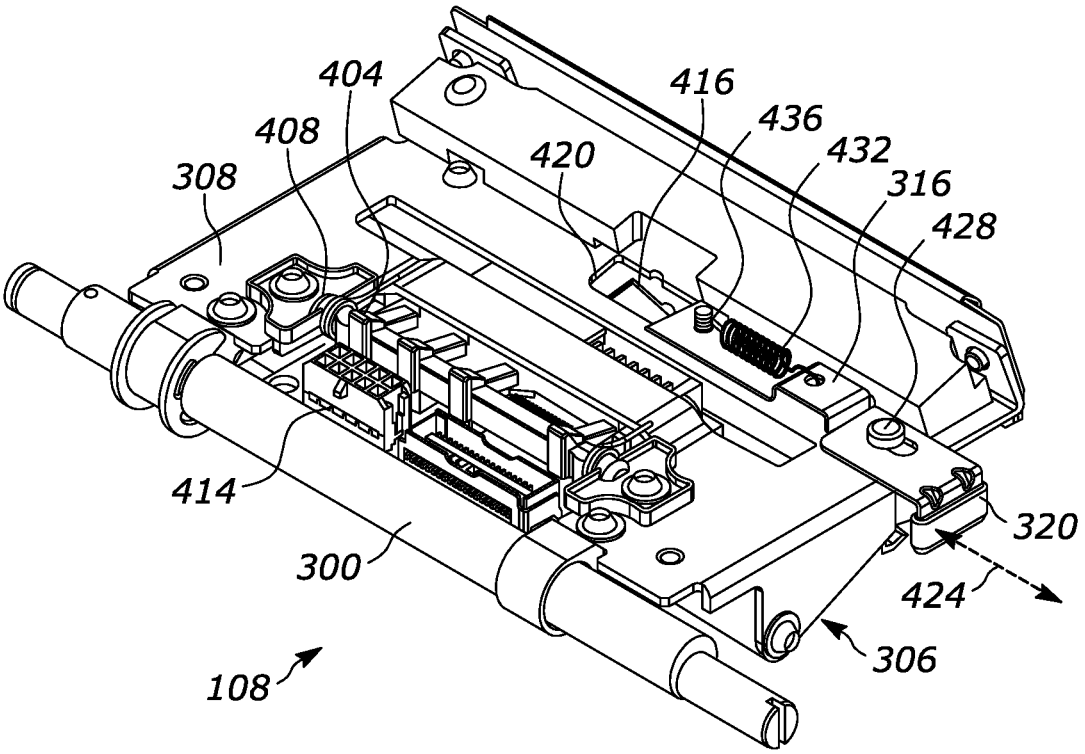
FIG. 5A is an isometric view of the print head assembly of FIG. 3 with a print head thereof in a maintenance position.

The latch bar 316 is movable between an engaged, or locked, position as shown in FIG. 4A, and an unlocked position shown in FIG. 5A. More specifically, the latch bar 316 slides along an upper surface of the base plate 308 responsive to manipulation of the latch bar 316, e.g. via the handle 320. As illustrated in FIG. 4A, the latch bar 316 slides along an axis 424, in either direction, between the engaged and disengaged positions. The extents of the movement of the latch bar 316 are set by one or more stops, such as a stop 428 affixed to the base plate 308 and extending through an elongated opening in the latch bar 316.

The latch bar 316 can be biased towards one of the above positions. In the illustrated example, the latch bar 316 is biased towards the engaged position by a bias member 432 such as a coil spring having one end connected to the latch bar 316 itself, and another end connected to the base plate 308, e.g. via a second stop 436.

Figure 5B:
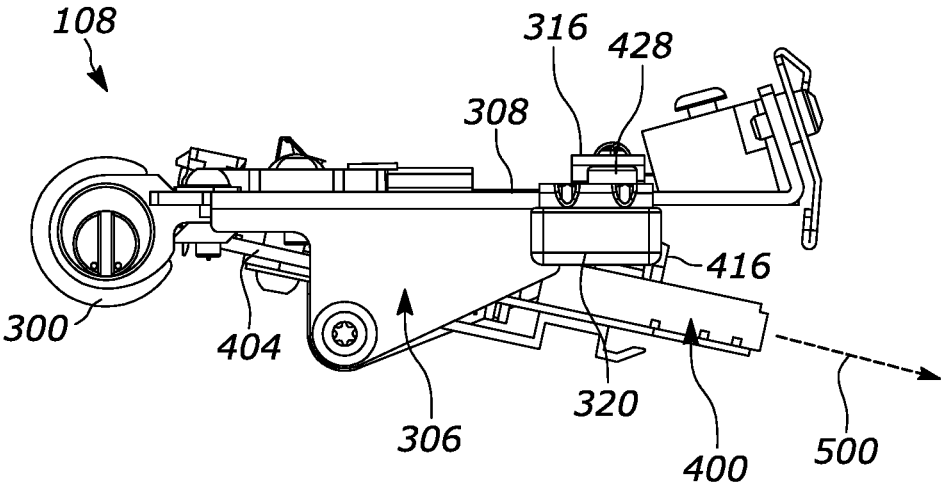
FIG. 5B is a side view of the print head assembly illustrated in FIG. 5A.

Turning to FIGS. 5A and 5B, the latch bar 316 is shown having been translated along the axis 424 to the disengaged position. For example, the handle 320 may be manipulated to pull the latch bar 316 away from the latch receiver 416, against the biasing action of the bias member 432. As seen in FIG. 5A, the latch bar 316 is retracted from under the latch receiver 416, and the latch receiver 416 is permitted to withdraw through the opening 420. As a result, the print head 400 and the adapter 404 rotate together, about the shaft 408, to a disengaged position best seen in FIG. 5B, in which the print head 400 no longer abuts the base plate 308. Instead, the print head 400 is spaced apart from the lower surface of the base plate 308, and may therefore more readily be removed from the adapter, e.g. by grasping and pulling the print head 400 in the direction 500.

Replacing the print head 400, or installing another print head, is achieved by connecting the print head 400 with the adapter 404 in a direction opposite from the direction 500, and rotating the print head 400 and adapter 404 up toward the base plate 308. The latch receiver 416 therefore traverses the opening 420 in the base plate 308, and the latch bar 316 can engage the latch receiver to lock the print head 400 in the operational position.

Figure 6:
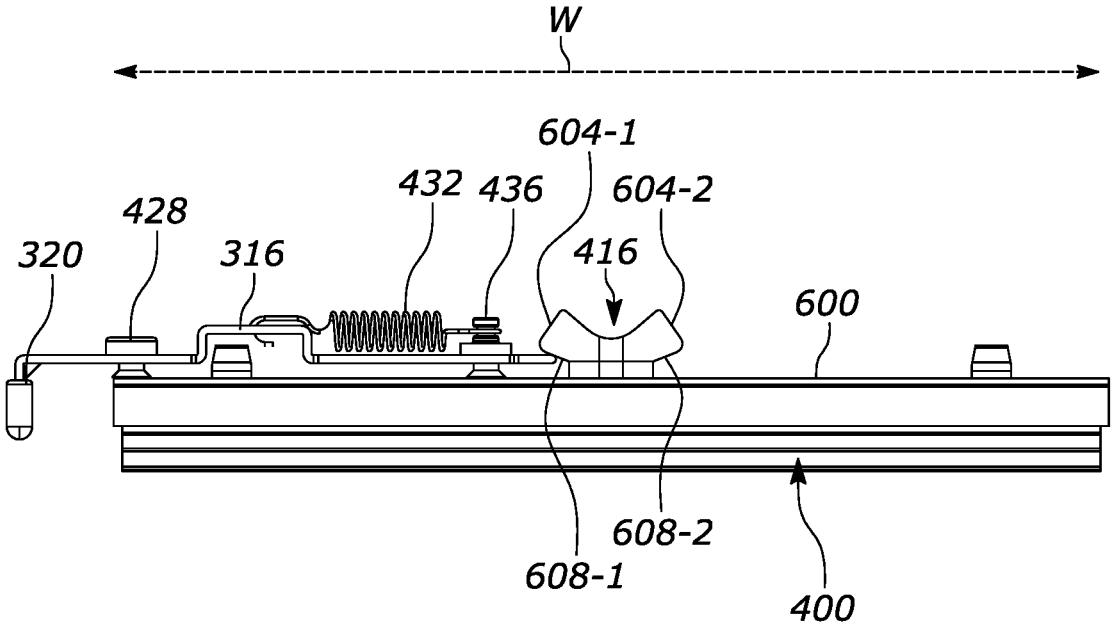
FIG. 6 is a front view of a print head of the print head assembly of FIG. 3.

Turning to FIG. 6, the print head 400, latch bar 316 and bias member 432 are shown in isolation. That is, the remaining components of the print head assembly 108 are omitted, including the base plate 308 (which would otherwise appear between the latch bar 316 and an upper surface 600 of the print head 400). As seen in FIG. 6, the latch receiver 416 extends from the upper surface 600 and includes a sloped upper surface. In the present example, the latch receiver 416 includes a first sloped upper surface 604-1 and a second sloped upper surface 604-2. The upper surfaces 604 are referred to as sloped because they have angles that are between parallel and perpendicular to the upper surface 600. In the present example, the upper surfaces 604 are inclined relative to the upper surface 600 at an angle of approximately 55 degrees, although a wide variety of other angles may also be employed.

The sloped upper surfaces 604 serve to push the latch bar 316 from the engaged position to the disengaged position as the latch receiver 416 travels upwards through the opening 420. As seen in FIG. 6, the upper sloped surface 604-2 does not come into contact with the latch bar 316 in the illustrated arrangement. Rather, the surface 604-2 is provided to enable the print head 400 to be employed in other media processing devices, in which the latch bar 316 is disposed on the other side of the carrier 306 than illustrated herein. The latch receiver 416 is also centered relative to the width "W" of the print head 400 to enable such cross-device compatibility.

The latch receiver 416 also defines at least one overhanging ledge. In the present example, first and second overhanging ledges 608-1 and 608-2 are provided, below the sloped upper surfaces 604-1 and 604-2, respectively. The latch bar 316 extends below one of the ledges 608 (the ledge 608-1 in the illustrated example) to prevent the latch receiver 416 from withdrawing through the opening 420, thus locking the print head 400 against the base plate 308.

Figure 7:
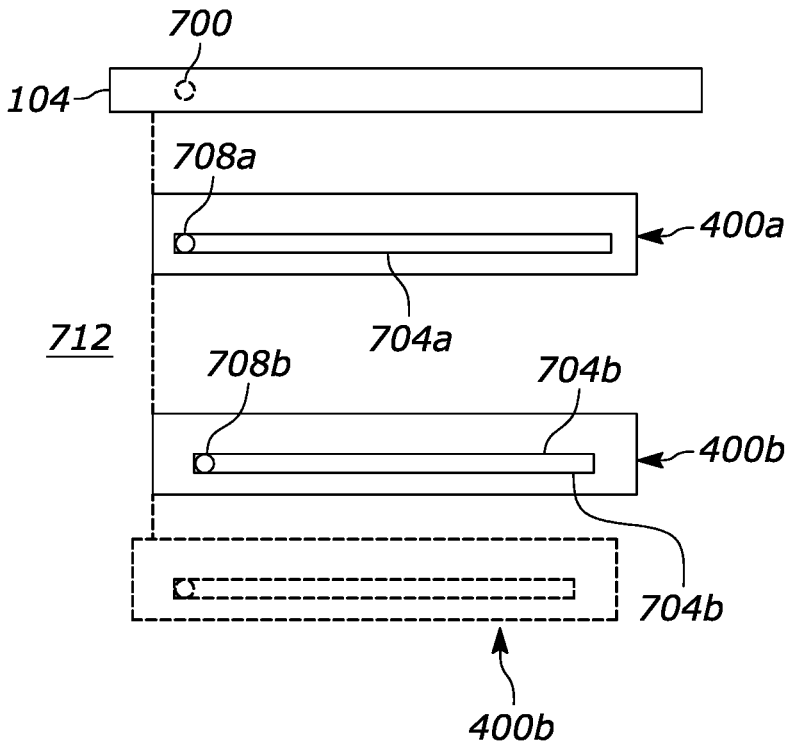
FIG. 7 is a diagram illustrating alignment of distinct print heads in a media processing device.

Turning now to FIG. 7, certain features of the device 100 will be described that enable adjustment of a print head position, e.g. to accommodate print heads with different print line dimensions. The platen roller 104 is shown in isolation, along with an indicator 700 of an expected first dot position for any print head placed in the device 100. Also shown in FIG. 7 is a simplified diagram of a first print head 400*a* including a print line 704*a*. The print line 704*a* may have a first resolution, such as six hundred dots per inch. The print head 400*a*, when installed in the device 100, is positioned so as to place a first dot 708*a* of the print line 704*a* at the first dot position 700. An alignment indicator 712 illustrates a position of the print head 400*a* relative to the platen roller 104 to correctly align the print line 704*a*.

FIG. 7 also illustrates a second print head 400*b* including a print line 704*b*. The print line 704*b* may provide a different resolution than the print line 704*a*. For example, the print line 704*b* may provide a resolution of two hundred and three DPI. In addition, the print line 704*b* has a smaller length than the print line 704*a*. Because the print lines 704 are centered on the respective print heads 400, the smaller length of the print line 704*b* results in a first dot 708*b* having a different position, relative to the housing of the print head 400*b*, than the position of the first dot 708*a* relative to the housing of the print head 400*a*. As a result, aligning the first dot 708*b* with the expected first dot position 700 requires an adjusted position within the device 100 for the print head 400*b*, illustrated in dashed lines. As will be discussed below, the device 100 includes features enabling such an adjustment of print head position.

Figure 8:
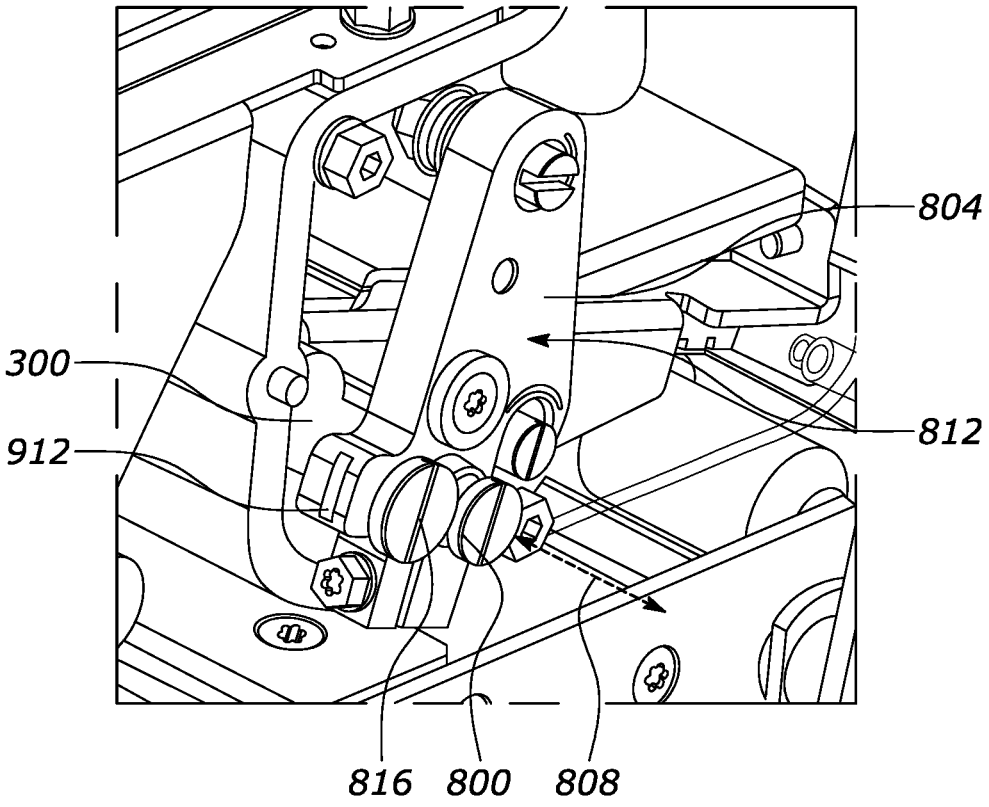
FIG. 8 is an isometric view of an adjustment block of a media processing device.

Turning to FIG. 8, another version of the adjustment block 212 is illustrated, in the form of an adjustment block 812. The plate 216 shown in FIG. 2 is omitted to reveal the shaft 300, an end of which is supported by the adjustment block 812. Specifically, the shaft 300 traverses an opening through the adjustment block 812 such that a head 800 of the shaft appears on an outer side 804 of the adjustment block 812, with the remainder of the shaft 300 extending into the device 100 from an inner side of the adjustment block 812.

As noted earlier, the print head 400 is affixed to the shaft 300 via the carrier 306. It follows, therefore, that the position of the print head 400 relative to the platen roller 104 can be adjusted as required in the scenario illustrated in FIG. 8 (e.g. to accommodate the print head 400*b*) by adjusting the position of the shaft 300 in the direction 808. The device 100 can also include further adjustment mechanisms (not shown) for the position of the shaft 300. For example, the operation of the adjustment block 812 described below can enable a coarse position adjustment for the shaft 300, and such other mechanisms can be used for positional adjustments.

To that end, the adjustment block 812 also carries a set element 816, such as a set screw, movable in the directions 808 between a first position and a second position. As seen in FIG. 8, the set element 816 engages with the adjustment block 812, and includes a head disposed between the outer side 804 of the adjustment block 812 and the head 800 of the shaft 300. Therefore, movement of the set element 816 outwards from the adjustment block 212 forces the head 800 (and therefore the shaft 300) to also travel outwards. Conversely, movement of the set element 816 inwards, toward the outer side 804 of the adjustment block 812, permits the head 800 and the shaft 300 to also travel inwards. Such movement of the shaft causes corresponding movement of the print head 400, enabling adjustment of the position of the first dot 708 of the print head 400 relative to the platen roller 104.

Figure 9:
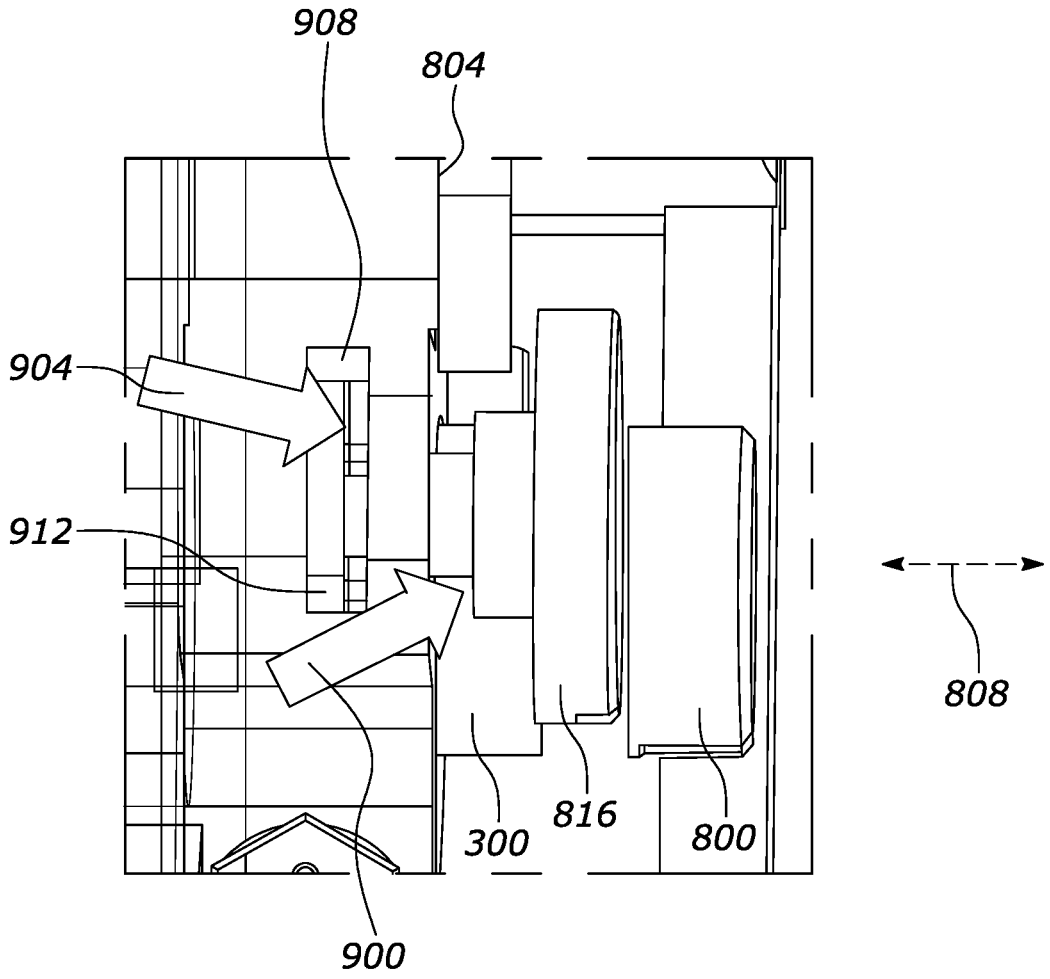
FIG. 9 is a front view of the adjustment block of FIG. 8.

The set element 816 can include first and second stops for limiting the extents of the inward and outward movement of the set element 816. In particular, as shown in FIG. 9, the set element 816 includes a first stop in the form of a shoulder 900 configured to abut against the outer side 804 of the adjustment block 812 and prevent further inward movement of the set element 816 (and therefore also of the head 800 and the shaft 300). The shoulder 900 may be configured to arrest inward movement of the set element 816 at a position that correctly aligns a first print head 400, e.g. the print head 400*a* shown in FIG. 7.

The set element 816 also includes a retaining ring 904 or other suitable structure to arrest further outward movement of the set element against an inner surface 908 of a chamber within the adjustment block 812. In other examples, the retaining ring (or a shoulder defined at the other end of the set element 816) can be on the inner side of the adjustment block, rather than within the chamber. The chamber is visible in FIG. 9 (and also in FIG. 8) through a slot 912, but the slot 912 may also be omitted in other examples (that is, the chamber may be fully enclosed within the adjustment block 812).

Adjustment of print head position may therefore be achieved by turning the set element 816 in a first direction to travel inwards until the shoulder 900 prevents further inward motion, or turning the set element 816 in a second direction to travel outwards until the retaining ring 904 prevents further outward motion. As will be apparent, the set element 816 can include a threaded portion that traverses the adjustment block 812 between the outer side 804 and the inner surface 908.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A print head assembly for a media processing device, the print head assembly comprising:

a print head including an interface and a latch receiver on an upper surface of the print head; and a print head carrier including:

(i) a base plate having an opening to receive the latch receiver therethrough when the print head is positioned at a lower surface of the base plate;

(ii) an adapter to engage with the interface of the print head; and (iii) a latch bar on an upper surface of the base plate, the latch bar slideable between a first position to engage with the latch receiver and lock the print head to the base plate, and a second position to disengage from the latch receiver and release the print head from the base plate;

wherein the latch receiver includes:

a sloped upper surface to push the latch bar from the first position to the second position when the print head is placed against the lower surface of the base plate; and a ledge below the sloped upper surface, and wherein the latch bar is configured to extend between the ledge and the upper surface of the base plate in the first position.

2. The print head assembly of claim 1, wherein the interface includes an electrical connector, and wherein the adapter includes a port to receive the electrical connector.

3. The print head assembly of claim 1, wherein the adapter is rotatable relative to the base plate between an operational position to place the print head against the lower surface of the base plate, and a maintenance position to rotate the print head away from the base plate.

4. The print head assembly of claim 1, wherein the print head carrier includes a bias member coupled between the base plate and the latch bar to bias the latch bar towards the first position.

5. The print head assembly of claim 1, wherein the latch receiver further comprises:

a second sloped upper surface and a second ledge thereunder, the second sloped upper surface and the second ledge for engaging with a second latch bar in an alternative media processing device configuration.

6. The print head assembly of claim 1, wherein the latch bar includes a handle portion disposed at a side of the base plate.

7. The print head assembly of claim 1, further comprising:

a shaft including a shaft head, the base plate being affixed to the shaft;

wherein the shaft is adjustable in an axial direction between a first shaft position and a second shaft position.

8. The print head assembly of claim 7, wherein the first shaft position corresponds to a first print head configuration, and wherein the second shaft position corresponds to a second print head configuration.

9. The print head assembly of claim 7, further comprising:

an adjustment block affixed to a housing of the media processing device, the adjustment block having an opening to receive an end of the shaft therethrough;

a set element connected to the adjustment block and the shaft, the set element configured to transition the shaft between the first shaft position and the second shaft position.

10. A print head assembly for a media processing device, the print head assembly comprising:

a print head including an interface and a latch receiver on an upper surface of the print head; and a print head carrier including:

(i) a base plate having an opening to receive the latch receiver therethrough when the print head is positioned at a lower surface of the base plate;

(ii) an adapter to engage with the interface of the print head; and (iii) a latch bar on an upper surface of the base plate, the latch bar slideable between a first position to engage with the latch receiver and lock the print head to the base plate, and a second position to disengage from the latch receiver and release the print head from the base plate, wherein the latch bar includes a handle portion disposed at a side of the base plate.

11. The print head assembly of claim 10, wherein the latch receiver includes a sloped upper surface to push the latch bar from the first position to the second position when the print head is placed against the lower surface of the base plate.

12. The print head assembly of claim 11, wherein the latch receiver includes a ledge below the sloped upper surface, and wherein the latch bar is configured to extend between the ledge and the upper surface of the base plate in the first position.

13. A print head assembly for a media processing device, the print head assembly comprising:

a print head including an interface and a latch receiver on an upper surface of the print head;

a print head carrier including:

(i) a base plate having an opening to receive the latch receiver therethrough when the print head is positioned at a lower surface of the base plate;

(ii) an adapter to engage with the interface of the print head; and (iii) a latch bar on an upper surface of the base plate, the latch bar slideable between a first position to engage with the latch receiver and lock the print head to the base plate, and a second position to disengage from the latch receiver and release the print head from the base plate;

a shaft including a shaft head, the base plate being affixed to the shaft, wherein the shaft is adjustable in an axial direction between a first shaft position and a second shaft position;

an adjustment block affixed to a housing of the media processing device, the adjustment block having an opening to receive an end of the shaft therethrough; and a set element connected to the adjustment block and the shaft, the set element configured to transition the shaft between the first shaft position and the second shaft position.

14. The print head assembly of claim 13, wherein the set element includes a set screw having a head disposed between an outer surface of the adjustment block and the shaft head.

15. The print head assembly of claim 14, wherein the set screw includes a threaded portion engaging with a wall of the adjustment block, and a first stop to engage with the outer surface of the adjustment block when the shaft has reached the first shaft position.

16. The print head assembly of claim 15, wherein the first stop is a shoulder formed by the set screw.

17. The print head assembly of claim 15, further comprising a second stop to engage with an inner surface of the adjustment block when the shaft has reached the second shaft position.

* * * * *